US006490952B2

(12) United States Patent
Junkers

(10) Patent No.: US 6,490,952 B2
(45) Date of Patent: Dec. 10, 2002

(54) FASTENING DEVICE

(76) Inventor: John K. Junkers, 7 Arrowhead La., Saddle River, NJ (US) 07540

( * ) Notice: Subject to any disclaimer, the term of this patent is extended or adjusted under 35 U.S.C. 154(b) by 0 days.

(21) Appl. No.: 09/369,006

(22) Filed: Aug. 5, 1999

(65) Prior Publication Data

US 2001/0039858 A1 Nov. 15, 2001

(51) Int. Cl.[7] ..... B25B 17/00
(52) U.S. Cl. ..... 81/57.39; 81/55; 81/56
(58) Field of Search ..... 81/57.39, 57.36, 81/55, 56, 57.22

(56) References Cited

U.S. PATENT DOCUMENTS

| | | | | | |
|---|---|---|---|---|---|
| 2,682,188 | A | * | 6/1954 | Ferrell | 81/56 |
| 2,789,597 | A | * | 4/1957 | Torre | 81/55 |
| 2,882,773 | A | * | 4/1959 | Wing | 81/56 |
| 3,028,777 | A | * | 4/1962 | Essex | 81/55 |
| 3,041,902 | A | * | 7/1962 | Wing | 81/56 |
| 3,247,741 | A | | 4/1966 | Batten | |
| 3,584,527 | A | * | 6/1971 | Bosten | 81/56 |
| 4,289,049 | A | * | 9/1981 | Rebish | 81/56 |
| 4,706,527 | A | * | 11/1987 | Junkers | 81/57.39 |
| 4,825,730 | A | * | 5/1989 | Junkers | 81/57.39 |
| 4,846,028 | A | | 7/1989 | Junkers | |
| 4,989,478 | A | * | 2/1991 | Trivedi et al. | 81/57.36 |
| 5,018,410 | A | * | 5/1991 | Farnsworth | 81/13 |
| 5,238,461 | A | * | 8/1993 | Gotman | 475/248 |
| 5,318,397 | A | | 6/1994 | Junkers | |
| 5,329,833 | A | * | 7/1994 | Sergan | 81/57.39 |
| 5,511,451 | A | * | 4/1996 | Steen et al. | 81/55 |
| 5,539,970 | A | | 7/1996 | Junkers | |
| 5,582,079 | A | * | 12/1996 | Matsumura et al. | 81/56 |
| 5,964,128 | A | * | 10/1999 | Kaneyama et al. | 81/56 |

FOREIGN PATENT DOCUMENTS

| | | | | |
|---|---|---|---|---|
| EP | 0 754 527 A | | 1/1997 | |
| GB | 2 130 513 | * | 6/1984 | 81/57.39 |

* cited by examiner

*Primary Examiner*—James G. Smith
*Assistant Examiner*—Hadi Shakeri
(74) *Attorney, Agent, or Firm*—Michael J. Striker

(57) ABSTRACT

A fastening system includes a bolt member, a nut to be turned, and a torque power tool operative for applying a torque to the bolt member and a torque to the nut to be turned simultaneously, so that during turning of the nut, the bolt member does not turn or twist due to torsion or side load, the bolt member including a rod and a washer having an axis, the rod having at least two portions located substantially at its ends, one of the portions being a threaded portion and located at one of the ends of said rod to connect with the nut to be turned while another of the portion located at the other of the ends of the rod is adapted to connect with an object, the washer having two opposite bearing faces extending substantially perpendicular to the axis and being subjected to turning friction, the bearing faces including an upper bearing face adapted to cooperate with a bearing face of the nut to be turned and a lower bearing face adapted to cooperate with a bearing face of one of the at least two parts, the torque power tool having a first drive structure connectable with the bolt member to apply a torque to the one portion of the rod and to the washer in one direction, and a second drive structure connectable with the nut to be turned to apply an equal force in an opposite direction, so that during operation of the torque power tool a turning friction of the washer is added to a turning friction of the one portion of the rod, so that the nut to be turned turns while the bolt member remains stationary.

12 Claims, 6 Drawing Sheets

FASTENING DEVICE

BACKGROUND OF THE INVENTION

The present invention relates generally to a fastening device for fastening bolts, nuts and the like.

Fasteners such as bolts and nuts are known. When the nut is tightened by means of torque, the bolt has a tendency to move along with the nut, while the reaction force applied by a torque power tool to a nearby stationary object applies a side load to the fastener to be tightened. The thread friction between a bolt and nut, is such, that it has the tendency to drag not firmly connected bolts along where the nut is torqued. In other words, the turning friction created by the nut to be turned in the bolt thread is at times greater than the turning friction of a counter-nut connected to the bolt on the other side of the parts to be connected, despite the fact that a turning counter-nut is subject to facial friction. Even if there is a washer underneath the nut to be turned, it too can drag along while the nut is turned.

When a bolt is threaded into a blind hole in the bottom part of the parts to be connected, it too has a tendency to turn along. For the above reasons, industry applies backup wrenches which stop the bottom nut from turning along or Allen keys that insert into a female hex on top of the blind stud to hold the stud from turning inside the threaded blind hole. This procedure is not always successful as the holding force varies with peak torque requirements resulting from flaws in the bolt thread. However, if it works on occasion or if the other bolt end is sturdly connected, then torsion builds up in the bolt shank apart from the side load created by reacting against the stationary object located distant from the bolt axis. On long bolts this can result in a loss of torque when the bolt unwinds. Thus, the turning of the bolt along with the nut, the built up of bolt torsion and the side load applied is non-desirable. It is therefore necessary to find a way to contravene the turning friction of the nut to be turned and the side load in such a way that the bolt remains stationary and the free bolt shank does not see any torsion or side load. As the side load is created through an offset reaction, the reaction force needs to become coaxial with the action force. This was accompanied by increasing the bolt turning friction relative to the nut turning friction so that the bolt member with its associated parts can be used as a stationary object. As the turning friction of the nut is shared between the threaded engagement with the bolt and the facial engagement with the parts to be connected or the washer, the turning friction of the bolt needs also to be shared. A bolt threaded into a blind hole or connected with a counter nut has one threaded friction there and another one where the bolt is connected with the nut to be turned. As the bearing face friction of the nut usually exceeds the threaded friction on the bottom end of the bolt, the bolt has a tendency to turn along where the nut is torqued. If a turning force is applied to a nut and an opposite and equal turning force is applied to a bolt, either one ends up turning. Therefore, it is necessary to either increase the bolt turning friction or to decrease the nut turning friction, so that when two equal but opposite forces are applied to the bolt and the nut, only the nut turns. This task was accomplished by making the turning friction of the bolt rod subject to the turning friction of the washer. Yet, this by itself does not mean anything because if a turning force is only applied to the nut, the bolt and the washer still can turn along and a side load is still applied to the bolt. It requires in addition a tool, which has an action force and an equal but opposite reaction force such as a torque power tool to guarantee that only the nut turns. By applying a torque power tool to the fastener in such a way that the turning force of the torque power tool in one direction is exerted to the nut and the equal but opposite turning force of the torque power tool is exerted to the bolt rod and the washer, only the nut turns.

A fastener is known in the art, such as for example the fastener disclosed my U.S. Pat. No. 5,318,397. It however has the disadvantage that the inner sleeve needs to be relatively radially thick at the point where it is connected to the washer, as the holding force applicable to the inner sleeve is transferred by the inner sleeve to the washer. Therefore, this connection can see in some instances the entire, opposite turning force applied to the outer sleeve. In addition, a fastener described in my previous patent is costly to produce.

SUMMARY OF THE INVENTION

Accordingly, it is an object of present invention to provide a fastening device which avoids the disadvantages of the prior art.

In keeping with these objects and with others which will become apparent herienafter, one feature of present invention resides briefly stated, in a fastening device which has a bolt member, a nut to be turned, and a torque power tool operative for applying a torque to the bolt member and torque to the nut to be turned simultaneously, so that during tightening of the fastener and turning of the nut, the bolt member does not turn or twist due to torsion or side load, the bolt member including a rod and a washer having an axis, the rod having two portions located substantially at is ends, one of the portions being a threaded portion and located at one of the ends to connect with the nut to be turned while another of the portion located at the other of the ends of the rod is adapted to connect with an object at the other end, the washer having two opposite bearing faces extending substantially perpendicular to said axis and being subjected to turning friction, the bearing faces including an upper bearing face adapted to cooperate with a bearing face of the nut to be turned and a lower bearing face adapted to cooperate with a bearing face of one of the two parts, the torque power tool having first drive means connectable with the bolt member to apply a torque to the one portion of the rod and to the washer in one direction, and second drive means connectable with the nut to be turned to apply an equal force in an opposite direction, so that during operation of the torque power tool a turning friction of the washer is added to a turning friction of the one portion of the rod, so that the nut to be turned turns while the bolt member remains stationary.

When the fastening device is designed in accordance with the present invention and includes the bolt member, the nut and the torque power tool as defined hereinabove, it eliminates turning of the bolt or of the washer along with turning of the nut.

In the inventive fastening device including the bolt member, the nut and the torque power tool, the tool when applied will eliminate that the bolt twists in its free shank due to torsion. With the fastening device in accordance with the present invention, including the bolt member and the torque power tool, the usual side load resulting from torque is eliminated.

When the fastener including the bolt and the nut is being tightened by means of the tool, the friction of the bolt relative to the friction of the nut changes. Also, the changed friction of the bolt is kept at all times in the same relation to the friction of the nut, even when the friction of the nut becomes temporarily greater due to kinks in the thread or other discrepancies.

With the inventive fastening device, the turning friction between the nut and the bolt is brought closer and it is possible to use standard commercial parts. A smaller diameter and a less expensive construction is feasible.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1B:
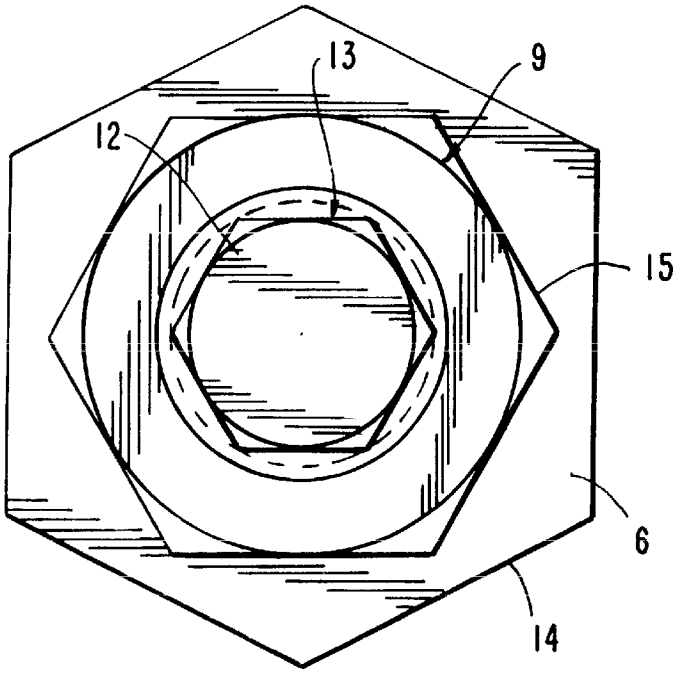
FIG. 1*b* is a plan view of the bolt and nut of the inventive device shown in FIG. 1*a;*
Figure 1A:
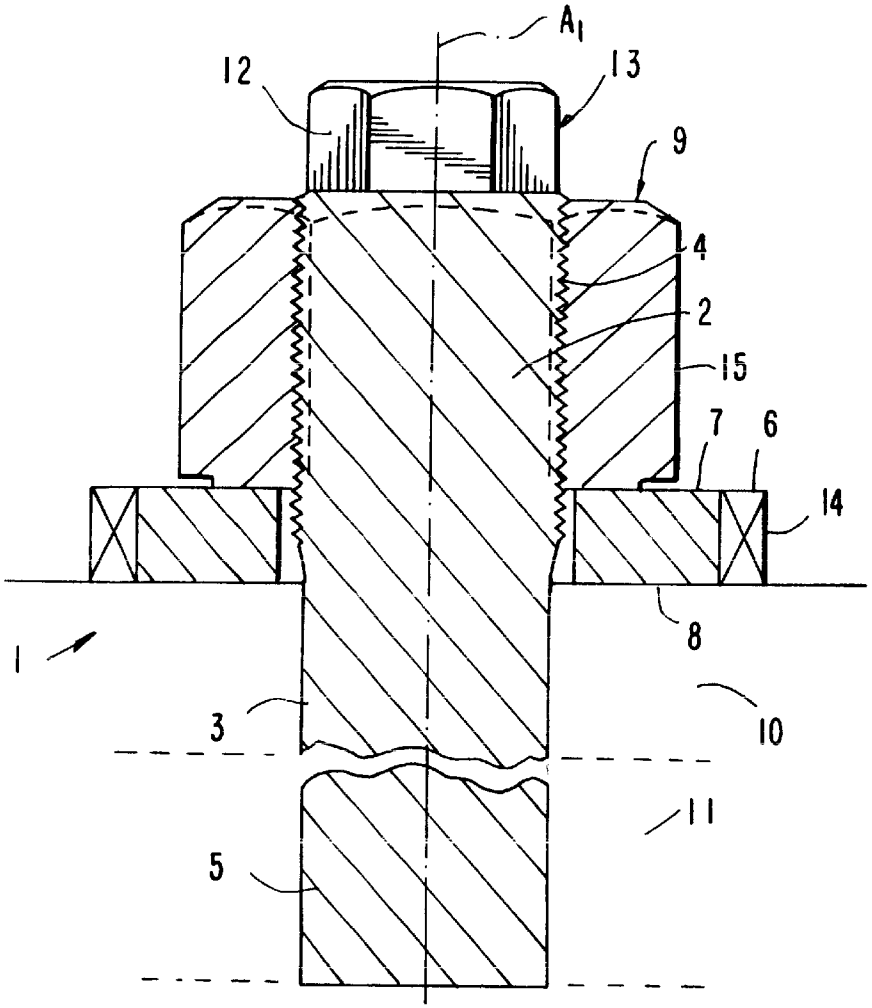
FIG. 1*a* is a side view of a bolt and a nut of an inventive fastening device in sections.

A fastening device in accordance with the present invention has a bolt member which is identified as a whole with reference numeral 1 and includes a bolt 2. The bolt 2 has a rod 3 with two portions 4 and 5. The threaded portion 4 is located at one end of the rod 3, while the portion 5, which also can be threaded is located at the other end of the rod. The bolt member further has a washer 6 having two bearing faces which are substantially perpendicular to an axis A1 of the bolt and are subjected to turning friction. The washer 6 has an upper bearing face 7 and a lower bearing face 8.

The fastening device further has a nut which is identified with reference numeral 9. The nut 9 is connected with the threaded portion 4 of the rod 3 by an inner thread and has a lower bearing surface cooperating with the upper bearing surface 7 of the washer 6. The nut and the bolt member are used to tighten upper and lower parts 10 and 11 with one another. The lower bearing face of the washer 6 cooperates with an upper part 10.

As can be seen from the drawings, above the thread portion 4 are engaging means 12. This can be a polygonal outer surface 13 which forms a connection to a first drive means of a toque power tool. The washer 6 has an outer polygonal surface 14 which also forms a connection to the first drive means of the torque power tool. Finally, the nut 9 has an outer polygonal surface 15 which forms a connection to a second drive means of the torque power tool.

Figure 2:
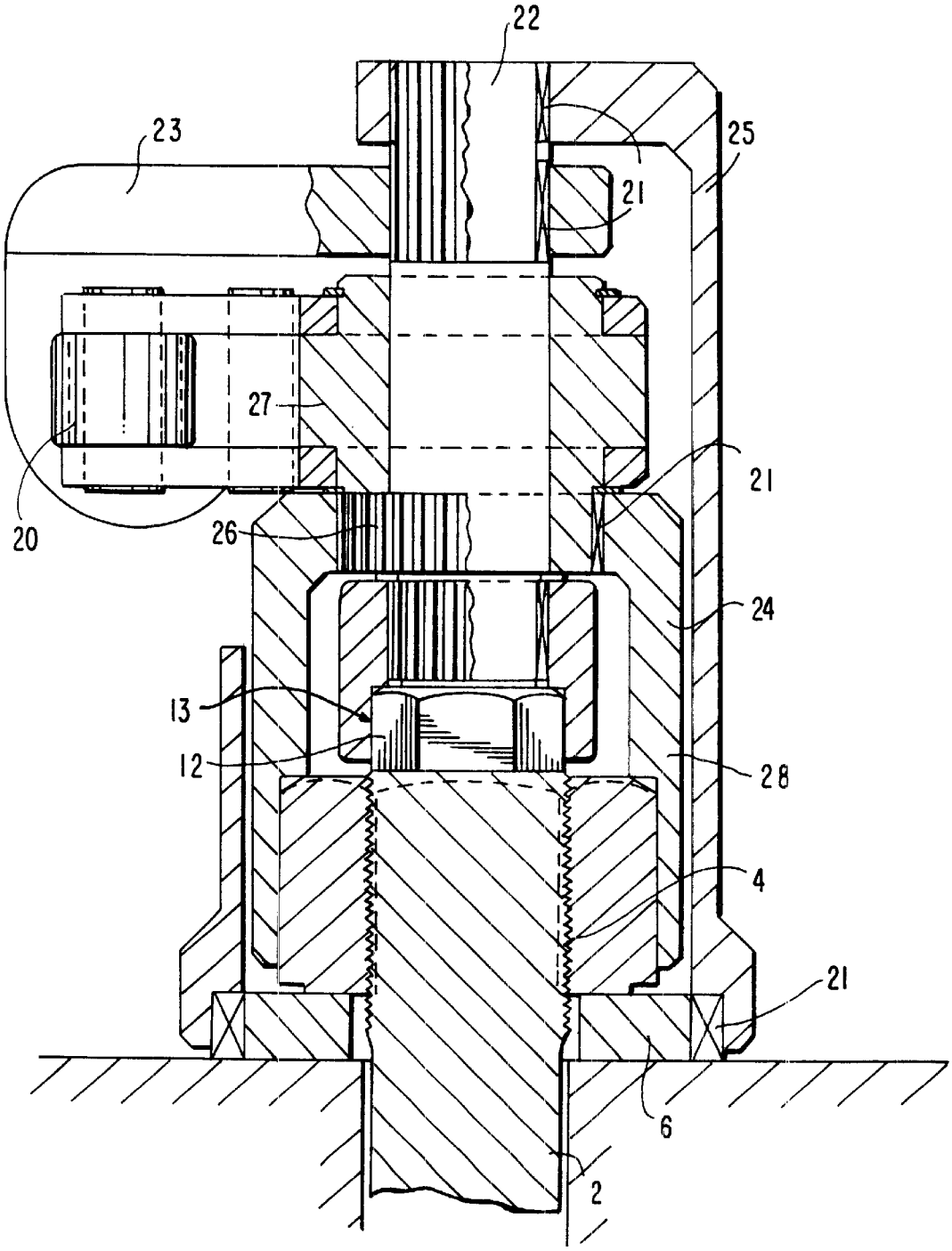
FIG. 2 is a view showing a torque power tool cooperating with the bolt and the nut of FIG. 1*a,* 1*b;*

FIG. 2 shows a torque power tool 20 cooperating with the bolt member 1 and the nut 9. The torque power tool 20 has first [drive] means identified with reference numeral 21. The first means first of all are connected to the threaded portion 4 of the rod 3 of the bolt 2. For this purpose the first means include a shaft 22 which is non rotatably engaged with a housing 23 of the tool for example by polygonal formations such as splines and the like. The socket 24 has an inner polygonal opening with which it is fitted on the outer polygonal surface 13 of engaging means 12 above the threaded portion 4. The first means 21 also include an outer socket 25 which is non rotatably connected with the shaft 22 for example by polygonal formations such as splines and the like and has a lower end having a polygonal inner opening with which it is fitted over the polygonal outer surface of the washer 6. Therefore, the first means 21 are connected to the engaging means 12 which includes the bolt 2 and the washer 6 to apply a torque to the threaded portion 4 of the rod 3 and to the washer 6 in one direction.

The torque power tool 20 further has second [drive] means 26 such include a ratchet 27 turnable by a not shown drive (pneumatic, hydraulic, etc.) through a pawl-ratchet engagement, as disclosed for example in my U.S. Pat. Nos. 4,671,142; 4,825,730; 5,499,558, etc., and provided for example with outer polygonal formations such as splines and the like, and a socket 28 which is no rotatably connected with the ratchet 27 by interengaging splines at the upper end and also has a lower end with an inner polygonal opening with which it is fitted on the outer polygonal surface 15 of the nut 9. The second means 26 are connected with the nut 9 to apply an equal torque in the opposite direction. Thus, while the first means 21 of the torque power tool 20 apply a torque to th threaded portion 4 of the rod 3 and to the washer 6, the second means 26 of the torque power tool apply an equal force to the nut 9 in the opposite direction. During operation of the tool, the turning friction of the washer 6 is added to the turning friction of the threaded portion 4 of the rod 3, so that the nut 9 to be turned turns while the bolt member 1 remains stationary.

Figure 3B:
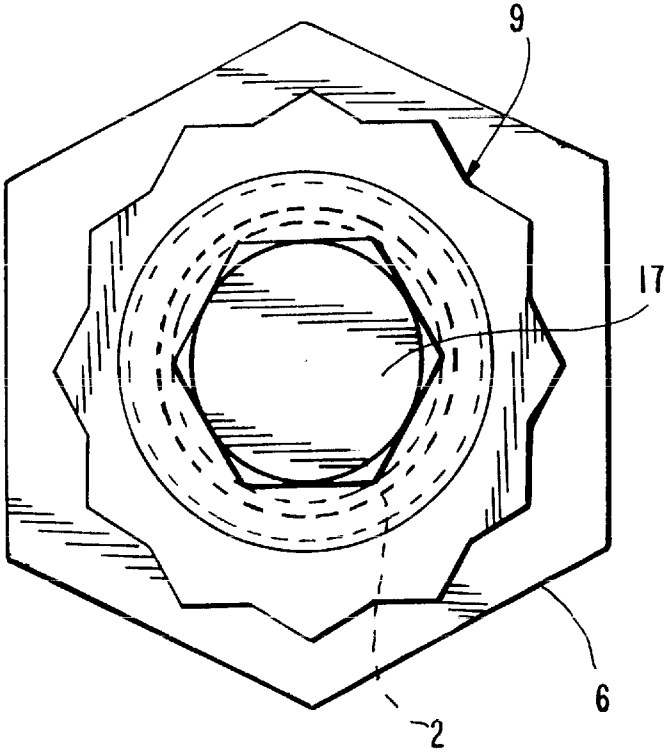
FIG. 3*b* is a plan view of the bolt and the nut of the inventive device shown in FIG. 3*a;*
Figure 3A:
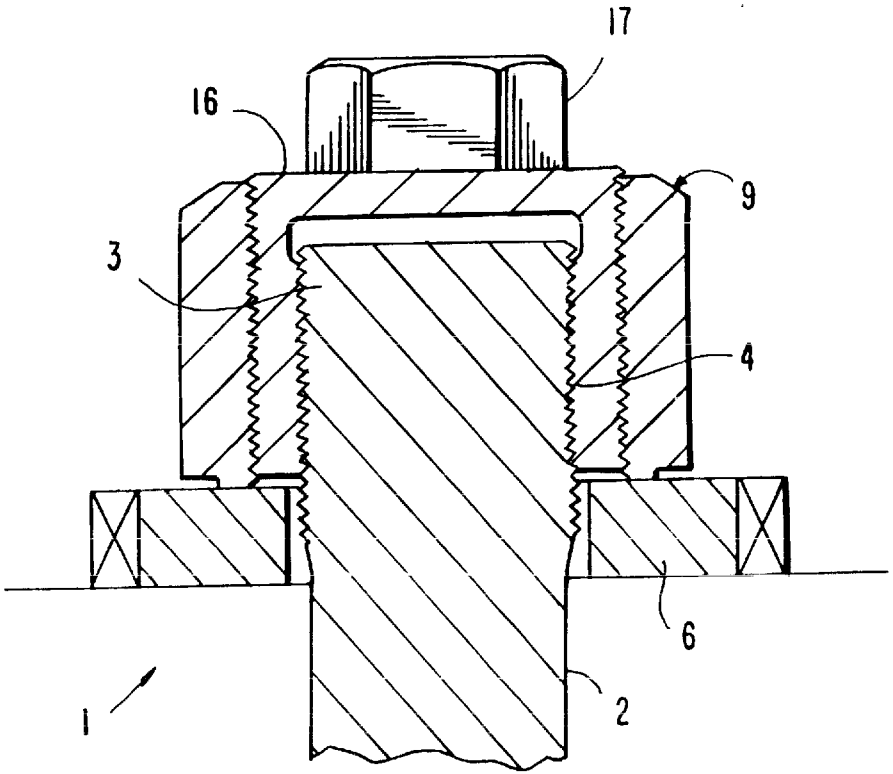
FIG. 3*a* is a section of a bolt and a nut in accordance with another embodiment of the present invention.

In the fastening assembly in accordance with the embodiment of FIG. 3, the parts which are identical to the corresponding parts to the first embodiment are identified with the same reference numerals. In this embodiment, it is not necessary to change a commercially available bolt. The bolt has an inner sleeve 16 which outside threads form the threaded portion 4 of the rod 3 to which the nut 9 is connected. The inner sleeve 16 is provided with an inner thread which engages with the thread of the rod 3. The inner sleeve 16 also has engaging means 12 which can be a polygonal surface 13.

Figure 4:
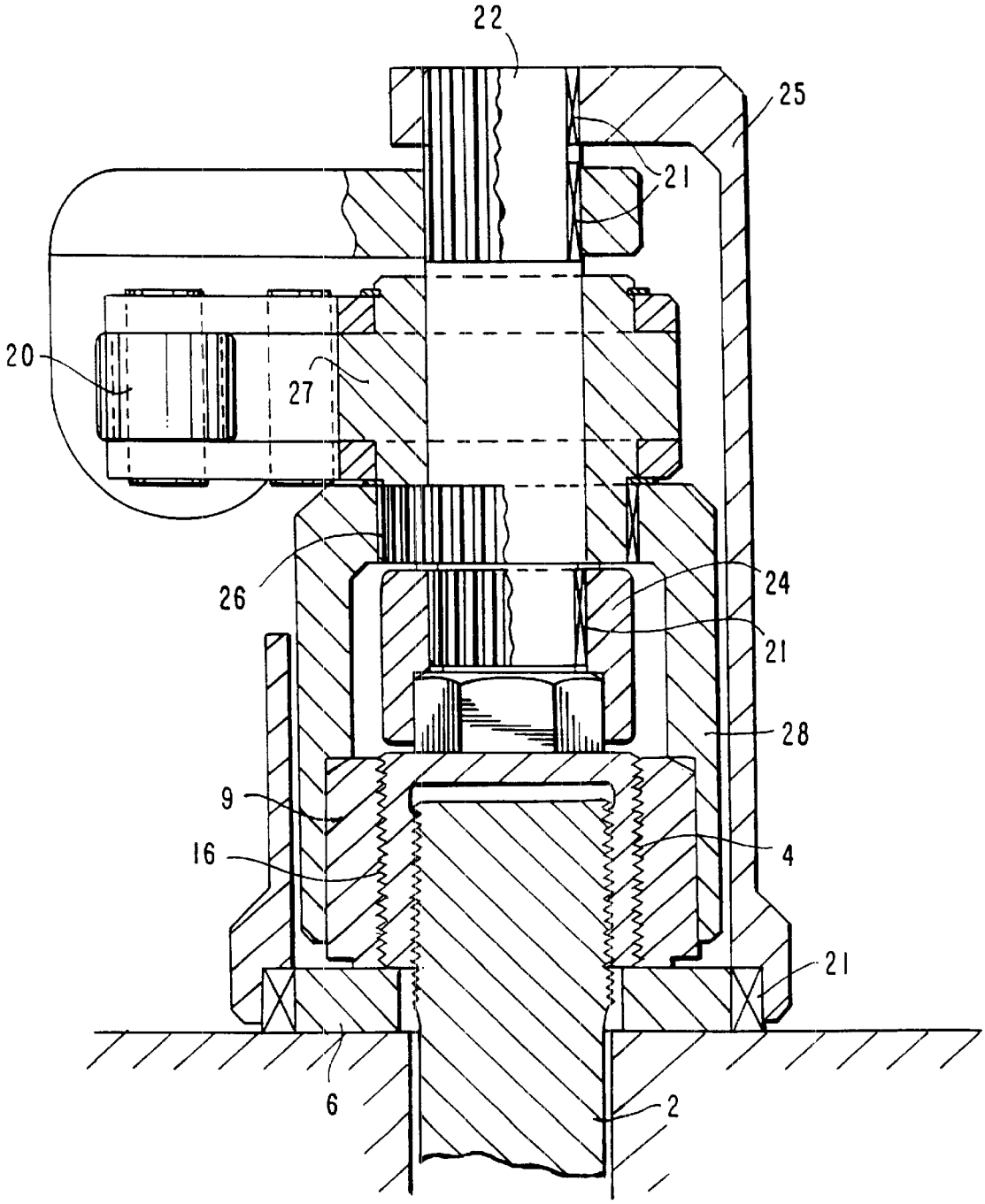
FIG. 4 is a view showing a torque power tool applied to the bolt and the nut of FIGS. 3*a,* 3*b;*

The torque power tool 20 for cooperation with the bolt member and the nut of FIG. 2 is shown in FIG. 4. It substantially corresponds to the torque power tool of FIG. 2. However, in the embodiment shown in FIG. 4, the socket 24 having an inner polygonal opening engages the polygonal surface of engaging means 12 which is arranged not on the rod, but instead on the inner sleeve 16, which in turn is in engagement with the rod 3 of the bolt 2. In this construction also the first drive means 21 apply a torque to the threaded portion 4 of the rod 3, and also to the washer 6, while the second drive means 26 apply an equal torque in the opposite direction to the nut 9.

Figure 5A:
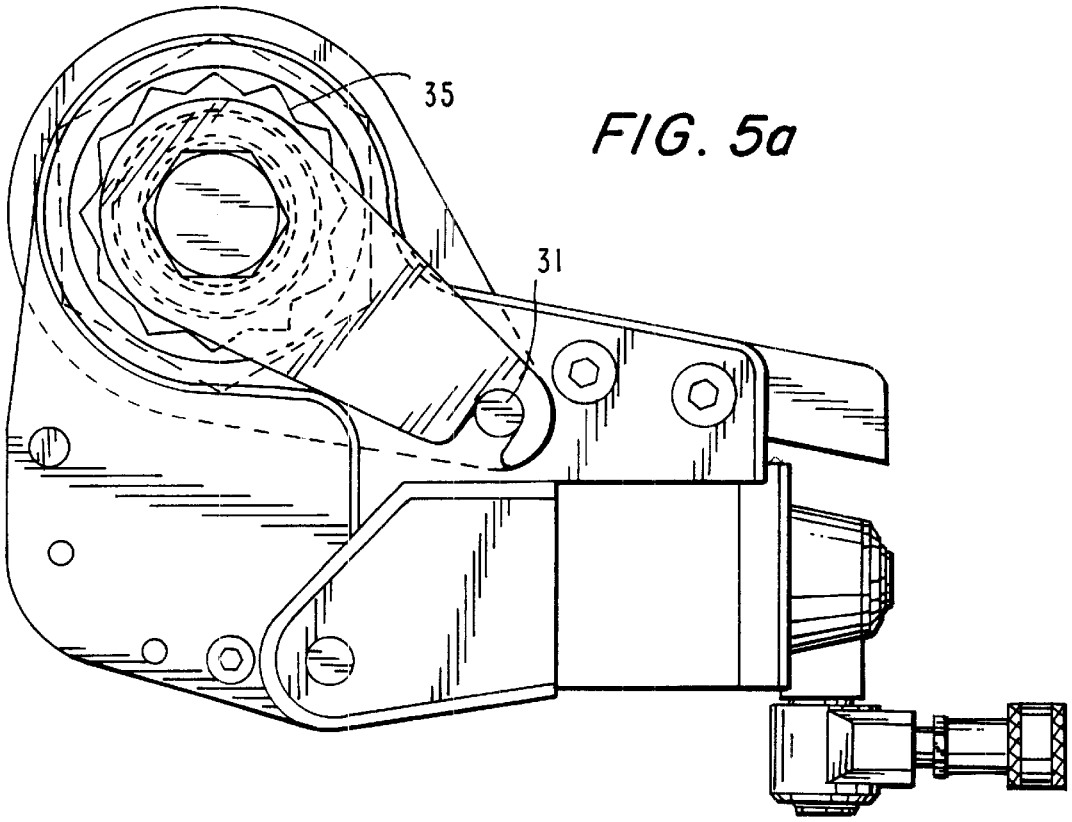
FIGS. 5*a* and 5*b* are a side view and a section of a torque power tool applied to a bolt and a nut in accordance with a further embodiment of the present invention.

A fastening device shown in FIGS. 5*a,* 5*b* also has first means identified with reference numeral 31. The first means include a pin 32 non rotatably connected to the housing of the tool, a first lever 33 having a right end non rotatably connected to the pin 32 and a left end provided with an inner hexagonal opening with which it is fitted over the hexagonal surface 13 of the engaging means 12, and another lever 34 having a first end which is non rotatably connected with the pin 32 and a second end having an inner polygonal opening with which it is fitted over the outer polygonal surface 14 of the washer 6. The torque power tool further has second [drive] means 35 which include a ratchet 36 located between drive plates 37 and turnable from a drive through a pawl-ratchet engagement. The ratchet 36 has an inner polygonal opening in which it is fitted on the outer polygonal surface of the nut 9. Here also the first [drive] means apply a torque to the threaded portion 4 of the rod 3 and to the washer 6 in one direction, while the second [drive] means 35 apply an equal torque in the opposite direction to the nut 9.

Figure 5B:
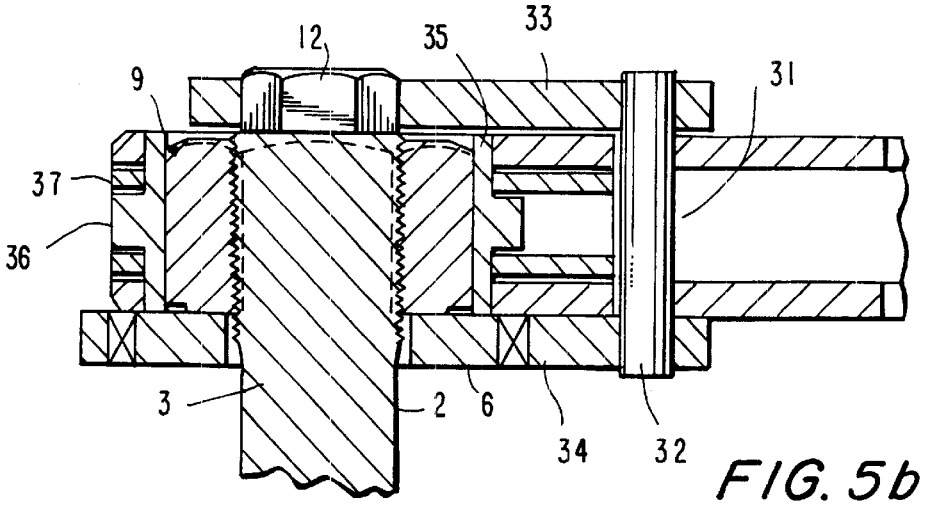
Figure 6A:
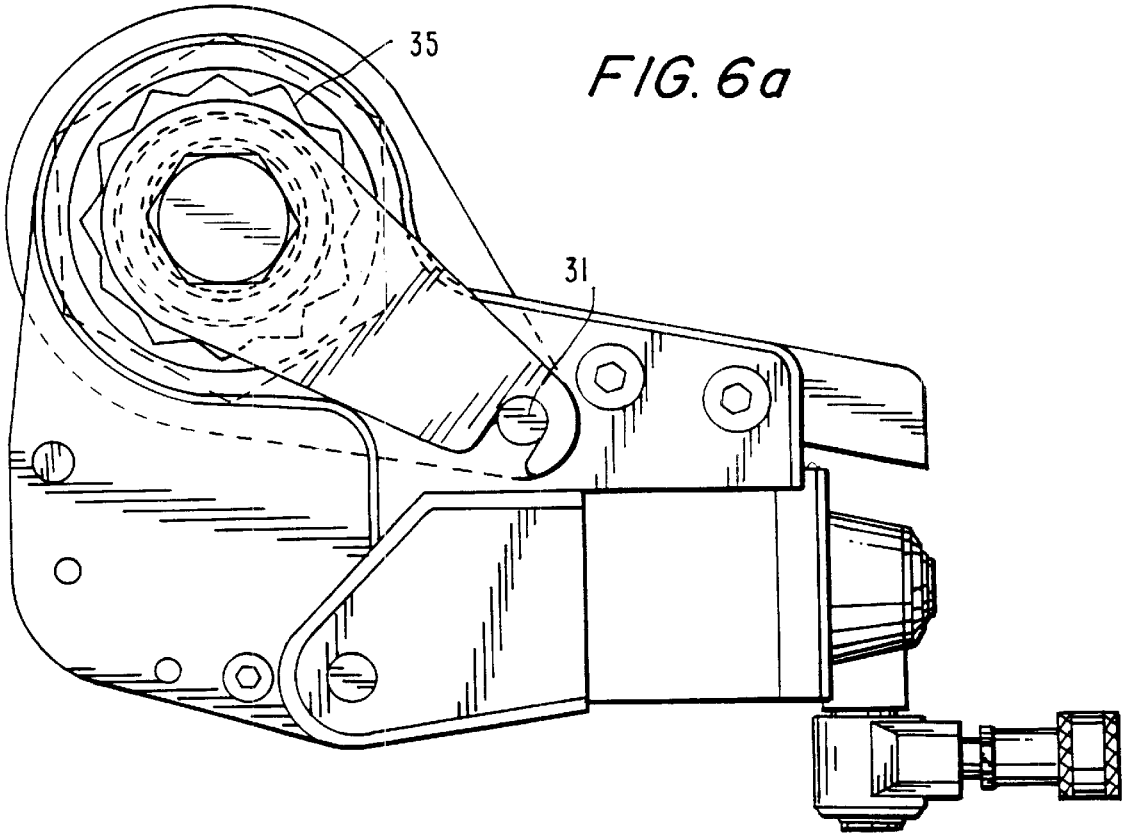
FIGS. 6*a* and 6*b* are a side view and a section of a torque power tool applied to a bolt and a nut in accordance with still another embodiment of the present invention.
Figure 6B:
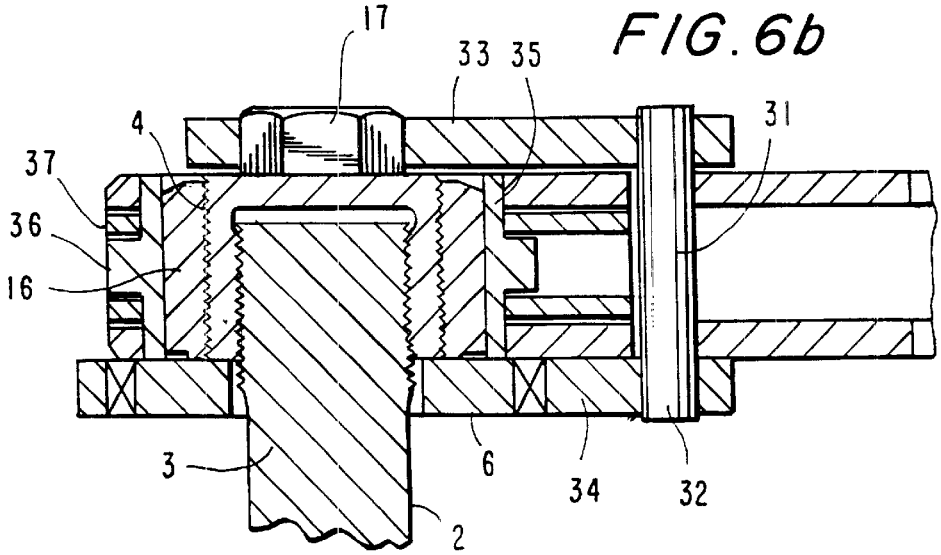

The embodiment shown in FIG. 6 substantially corresponds to the embodiment of FIG. 5. The difference in the embodiment shown in FIG. 6 from the embodiment in FIG. 5 is that here the ratchet is fitted with its inner polygonal opening on the outer polygonal surface of the nut 9 of FIG. 3, which engages with its inner thread the threaded portion 4 of the rod 3 that is provided with the engaging means 12. Here also the first means 31 apply a torque to the threaded portion 4 and to the washer 6 in one direction, while the second means 35 apply an equal torque in the opposite direction to the nut 9.

In all embodiments of the present invention, the bolt twist is eliminated due to torsion by use of the first means that assures that the bolt member remains stationary when a reaction force is applied to the bolt member, by use of the second means that assures that only the nut turns when the opposite and equal action force of the tool is applied to it.

While the invention has been illustrated and described as embodied in fastening device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A fastening system, comprising a bolt member; a nut to be turned; and a torque power tool operative for applying a torque to said bolt member and torque to said nut to be turned simultaneously, so that during turning of said nut, said bolt member does not turn or twist due to torsion or side load, said bolt member including a rod and a washer having an axis, said rod having at least two portions located substantially at ends of said rod, one of said portions being a threaded portion and located at one of said ends of said rod to connect with said nut to be turned while another of said portions located at the other of said ends of said rod is adapted to connect with an object, said washer having two opposite bearing faces extending substantially perpendicular to said axis and being subjected to turning friction resulting from turning of said nut by said power tool, said bearing faces including an upper bearing face adapted to cooperate with a bearing face of said nut to be turned and a lower bearing face adapted to cooperate with a bearing face of an object to be fastened, said torque power tool having first means connectable with said bolt member to apply a first force to said one portion of said rod and to said washer in one direction, and second means connectable with said nut to be turned to apply an equal second force in an opposite direction, so that during operation of said torque power tool a turning friction of said washer is added to a turning friction of said one rod and said first force is applied simultaneously to said washer and said one rod at all times during the operations, so that said nut to be turned turns while said bolt remains stationary.

2. A fastening system as defined in claim 1, wherein said one threaded portion of said rod of said bolt member has a threaded sleeve.

3. A fastening system as defined in claim 1, wherein said first means is coaxial with said second means of said torque power tool.

4. A fastening system as defined in claim 3, wherein said second means turns outside of said first drive means.

5. A fastening system as defined in claim 3, wherein said second means turns inside said first means.

6. A fastening system as defined in claim 1, wherein said first means are connected with said bolt member coaxially and at points located outside and inside said second drive means.

7. The fastening system as defined in claim 4, wherein said first means are connected with said one threaded portion of said rod and with said washer.

8. A fastening system as defined in claim 5, wherein said first means are connected with said one threaded portion of said rod and with said washer.

9. A fastening system as defined in claim 4, wherein said first means located inside said second means are connected with said one threaded portion of said rod.

10. A fastening system defined in claim 5, wherein said first means located outside said means are connected with said washer.

11. A fastening system as defined in claim 4, wherein said first means located outside said second means are connected with said washer.

12. A fastening system as defined in claim 5, wherein said first means located outside said second [drive] means are connected with said one threaded portion of said rod.

* * * * *